US005205767A

United States Patent [19]

Potocnik

[11] Patent Number: 5,205,767

[45] Date of Patent: Apr. 27, 1993

[54] PROPELLING SYSTEM SUITABLE FOR USE ON WATERCRAFT

[76] Inventor: Lucio Potocnik, Via D. Rossetti 41, 34141 Trieste TS, Italy

[21] Appl. No.: 768,411

[22] PCT Filed: Apr. 2, 1990

[86] PCT No.: PCT/IT90/00038

§ 371 Date: Oct. 7, 1991

§ 102(e) Date: Oct. 7, 1991

[87] PCT Pub. No.: WO90/11928

PCT Pub. Date: Oct. 18, 1990

[30] Foreign Application Priority Data

Apr. 5, 1989 [IT] Italy ..... 82803 A/89

[51] Int. Cl.[5] ..... B63H 5/02

[52] U.S. Cl. ..... 440/90; 114/290; 440/92

[58] Field of Search ..... 440/48, 90, 92, 69; 114/290, 67 R, 142

[56] References Cited

U.S. PATENT DOCUMENTS

| | | | |
|---|---|---|---|
| 515,883 | 3/1894 | Pelletier | 440/92 |
| 931,016 | 8/1909 | Pfantz | 440/90 X |
| 1,320,020 | 10/1919 | Maly | 114/67 R |
| 3,791,329 | 2/1974 | Bruning | 114/290 |
| 3,981,260 | 9/1976 | Hilbig | 114/67 R |
| 4,070,982 | 1/1978 | Willyard | 115/16 |
| 4,091,761 | 5/1978 | Fehn | 114/290 |

FOREIGN PATENT DOCUMENTS

| | | | |
|---|---|---|---|
| 416854 | 9/1936 | Belgium . | |
| 88694 | 4/1987 | Japan | 114/142 |
| 285341 | 8/1952 | Sweden . | |
| 968381 | 9/1961 | United Kingdom . | |
| 1090062 | 11/1967 | United Kingdom . | |

OTHER PUBLICATIONS

M. W. Beardsley; 12(9);10–24; (1973); "Surface Impulse Propulsion: A Review and Comment on Future Potential".

*Primary Examiner*—Sherman Basinger
*Attorney, Agent, or Firm*—Browdy and Neimark

[57] ABSTRACT

The main rotor (1) located at the bow (3) of the hull (4) is transverse to a vertical plane through the axis of the hull and consists of two or more units of cylindrical wheels (5), which are equipped with blades (17). Each unit of cylindrical wheels (5) is provided with its own independent braking device (13). Longitudinal channels (30 and 31) are made on the bottom (29). These channels have different cross-sections along the axis of the hull. To be more precise, their cross-sections decrease from bow (3) and stern (32) to the bottom center (29). Secondary propelling and maneuvering devices consist of secondary rotors (2), water-jets or similar components which are housed on the bottom (29) in pairs of two.

2 Claims, 7 Drawing Sheets

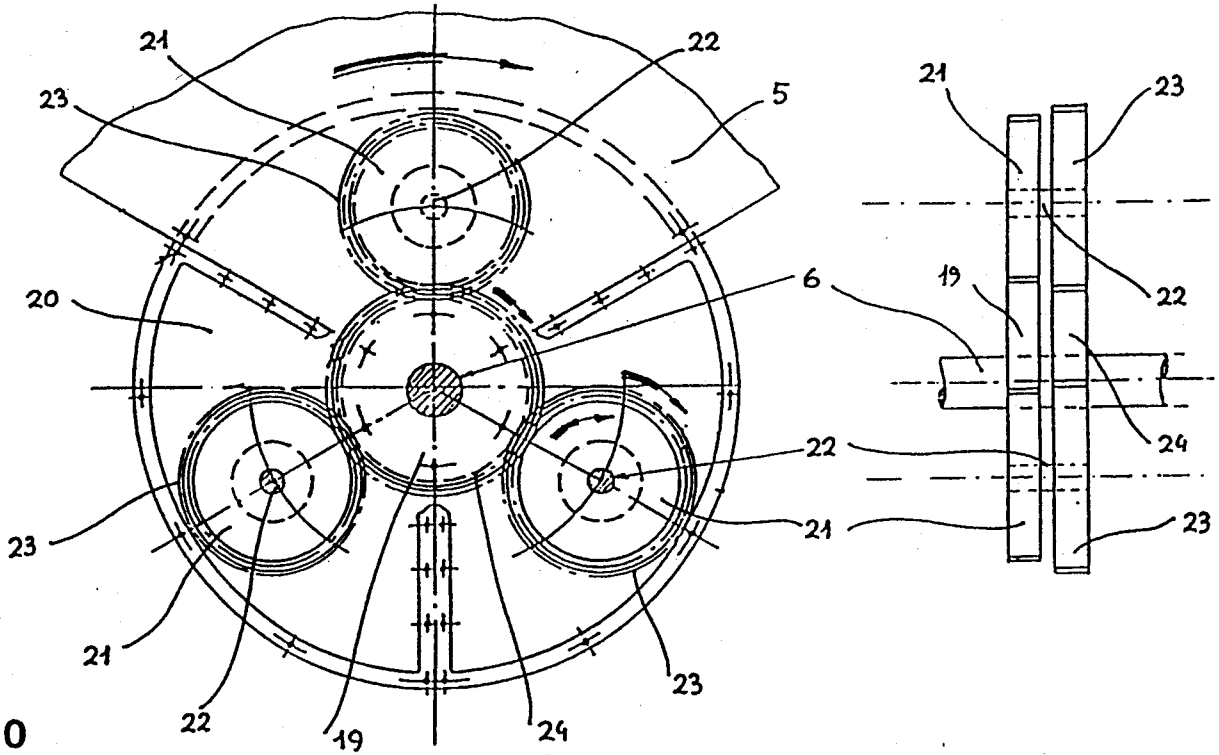
FIG. 11
FIG. 10
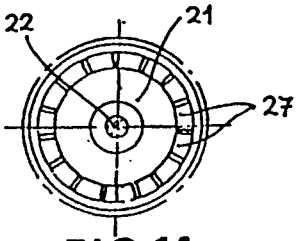
FIG. 14
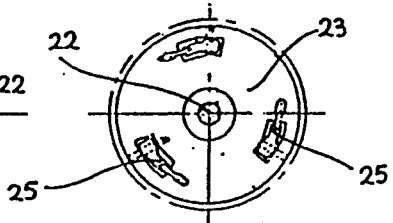
FIG. 13
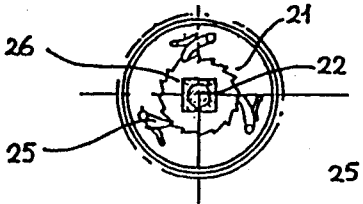
FIG. 12

PROPELLING SYSTEM SUITABLE FOR USE ON WATERCRAFT

BACKGROUND OF THE INVENTION

As everyone knows, there have been very few significant innovations in the ship-building sector over the last few decades.

Actually, ordinary merchant and naval watercrafts are being built on the basis of long known ship-building techniques. Among these techniques, the most important (and popular) ones—concerning quickwork—include the use of the V-shaped bow, bottom with a developed keel, rudder and propeller.

All the above-mentioned parts have been remarkably improved on pleasure- and racing-watercrafts, whereas very few steps forward have been made with regard to merchant crafts.

The use of the V-shaped bow, that allows the ship to plough the waters and the bottom to enter the hollow just created, is still up-to-date; the researches carried out to improve its shape have resulted in fair improvements. However, it is worth recalling that over the last few years the use of a bulb applied on the bow, immediately below sea level, has contributed to reduce wave resistance in medium and high tonnage ships.

A further technical amelioration, regarded as essential today, is the use of a bottom with a developed keel, in order to reduce roll and pitch especially during sea storms.

The use of a propeller for the craft propulsion is another widespread achievement in the ship-building sector.

This propelling unit has been thoroughly studied for several years; remarkable improvements have been made to its shape, blades' features and overall structure. Attempts have also been made to improve the overall efficiency of the propeller as much as possible (according to its bottom shape), but rarely has it exceeded 60–70%.

Finally, the use of the helm unit must be regarded as a vital accomplishment in order to manoeuvre the watercraft. This unit has undergone a progressive—yet slow—technical evolution, since its effect in slowing down the ship motion is well established and therefore does not require too many improvements. In spite of the continuous progress in designing, propelling and improving techniques, the results so far obtained cannot be compared to those achieved in the sectors of land and air vehicles, where new technological innovations have remarkably increased their speed and manoeuvrability and simultaneously reduced their operating costs. Indeed, the use of V-shaped bows and current hull shapes on merchant ships has not yet enabled these ships to overcome the wave resistance opposing their heading at high speeds—unless their bearing structures have been remarkably reinforced. However, this stiffening solution would bring about considerably higher building costs and, above all, higher operating costs, since fuel consumption increases dramatically.

Moreover, during navigation, the use of propeller and helm units causes a great waste of energy, which is proportional to the ship speed.

As already mentioned, the propeller efficiency is unlikely to exceed 70% and the use of helm in each sheer causes cavitation and braking, thus resulting in an increase in fuel consumption in order to keep the ship speed constant.

It should also be stressed that even a highly developed keel and the propeller and helm fastenings are likely to cause a waste of energy due to their frictional resistance during navigation.

OBJECTIVES OF THE INVENTION

The main object of this invention is to provide users with a completely new and original propelling and manoeuvring system suitable for use on watercrafts; also thanks to a peculiar design of the craft bottom, this system allows the ship to overcome the abovementioned failures and reach high speeds by exploiting its design potential to its utmost.

Another aim of this invention is to lead to the construction of watercrafts that can sail ploughing through waves by means of an unusually shaped bow and remarkably reducing wave resistance and pitching. A further object is to control the ship using a newly conceived system, which manoeuvres the ship by means of a thrusting device (instead of a braking one) and contributes to its overall propulsion.

This invention also aims at reducing the watercraft rolling and pitching by means of a new and useful system, which at the same time facilitates the functioning of the other propelling manoeuvring units.

An important object is to build a new watercraft with its bottom and upperworks designed in a different and unusual way, to reduce frictional resistance and benefit from the above-mentioned goals as much as possible.

Furthermore, this invention is to allow the construction of merchant watercrafts (for passengers and/or goods), which would operate at definitely lower running costs.

SUMMARY OF THE INVENTION

These objects and many others will be attained thanks to the propelling system of this invention. It consists of a main rotor, which is fitted on the craft bow and transversal to the sheer plan; a set of longitudinal channels made on the bottom; secondary propelling and manoeuvring devices including rotors, water-jets or other units, housed on the bottom in pairs of two. These secondary devices are assembled in pairs, which are transversal to the sheer plan.

The main rotor includes an even number of sets of cylindrical wheels supported by two axle shafts, which are transversal to the sheer plan and connected by a differential driven by any kind of engine by means of a driving shaft equipped with a gear box.

The above-mentioned cylindrical wheels have different diameters (decreasing from the sheer plan to the sides); each of them consists of two removable disks, a hub and a crown, whose external surface supports some blades specifically designed to permit watercraft heading only.

The motion of each unit on the main rotor is transmitted from the differential to the nearest cylindrical wheel, then from that to the next one and so on, by means of a epicyclic gear train, which involves some ratchet gears that transmit only positive motion (i.e. ahead) to the various cylindrical wheels of the same unit. Morevoer, the epicyclic gear train of each cylindrical wheel are designed and placed in such a way as to multiply the peripheral speed of both the cylindrical wheel housing them and the adjacent one driven by the former.

Each axle shaft of the main rotor is provided with its own independent braking device so that, when pulling the braking devices placed on one side of the sheer plan and increasing the revolutions of the cylindrical wheels on the other side, the watercraft sheers away on that side.

The main rotor top, front and sides are protected by a hemispherical coverage, which forms the watercraft bow and is jointed to the rest of the hull. Therefore, the whole bow has a hemispherical shape, whose upperworks is formed by a forward coverage and quickwork by the main rotor.

The above-mentioned channels, conveying the water thrusted by the main rotor towards stern, also function as stabilizers of roll and pitch and at the same time contribute to propulsion; they are arranged lengthwise and along all the bottom; each of them has variable cross-sections (along the sheer plan). To be more precise, their cross-sections decrease from bow and stern to the bottom centre, thus creating a narrowing in this area.

Therefore, the longitudinal design of each channel allows the application of the Venturi effect. Each secondary rotor consists of a cylinder whose external surface has a certain number of blades. It is supported by a shaft, which is transversal to the hull and connected, by means of driving belts, axle shafts (provided with a gear box) or other units, to a differential (one for each pair of secondary rotors). This differential, in its turn, is connected with an engine by means of a driving shaft.

In each secondary rotor, one or more blades (from their tips) can each eject a fin driven by a sliding piston in a cylinder.

This piston, when hydraulicly actuated, acts on a rod stiffly connected with the fin itself, thus causing the fin ejection; some proper return springs (stiffly connected to the rod) let each fin withdraw to its original seat when the hydraulic pressure on pistons is released.

The hull has longitudinal bilge keels along the external sides of the bottom. Moreover, the longitudinal central part of the bottom is practically flat, whereas the bottom is slightly tilted transversally and upwardly along the sides. The bottom is also inclined lengthwise and upwardly at bow.

The shape of upperworks is aerodynamic thanks to a hemispherical bow, a regularly shaped hull and a lean stern jointed to the bottom. This shape allows the application of the Zeppelin effect. Indeed, according to Zeppelin, a body moving ahead in a fluid will face a lower resistance if the shape of its front is like a hemisphere, not a blade.

The above-mentioned aims are attained by means of the propelling system herein described.

The watercrafts using this system can undoubtedly reach high speeds by exploiting its design potential to its utmost, since resistance to heading is reduced and, at the same time, propulsion is provided by suitable devices.

The main rotor placed at bow breaks the waters with the blades housed in its cylindrical wheels, thus allowing a remarkable decrease in the wave resistance opposing the ship heading at high speeds.

Frictional resistance is also reduced. Actually, frictional resistance remarkably decreases thanks to the bottom shape, reduced displacement (due to the bottom shape) and lack of helm, propellers and other external outfits causing frictions, eddies and waves. Even the overall heave of the hull at high speeds contributes to reduce both wave and frictional resistance.

Air resistance is also reduced by the aerodynamic shape of upperworks, which allows the application of Zeppelin's theory.

Indeed, air resistance is reduced by the hemispherical forward coverage piercing the air and creating a gap through which the hull slides, with a constant section and without sharp edges. Hence the exclusion of any superstructure, such as chimneys, masts, decks, turrets, etc., causing considerable air resistance at present.

Any increase in efficiency is mainly achieved thanks to the new manoeuvring system of the craft. Any sheer is actually achieved through the thrust powered by the forward rotor and propelling/manoeuvring devices placed on the bottom, thus excluding the braking effect of the helm.

The position of secondary rotors, water-jets or other similarly operating devices allow the hull to perform variations, evolutions and deviations from course by rotating on its axis pivoting on the hull centre and no longer at stern, as still occurs at present/

A further increase in efficiency is brought about by the channels made on the bottom. Thanks to their peculiar design, they convey the water forced in from bow and thrust it towards stern, thus allowing the application of the Venturi effect.

In order to benefit from this propelling system as much as possible, the bottom design is different from any traditional one: it tilts transversally (outwardly and along bottom sides) so as to find the angle of direction and stability; the bottom is practically flat in its longitudinal central part to favour the action of its channels. Moreover, the whole bottom slightly tilts lengthwise and upwardly at bow to facilitate the water conveyance (underneath the bottom itself) from forward rotor and its thrusting into the above-mentioned channels.

The use of this kind of bottom allows to reduce the degree of hull's draft recorded by current ships, by decreasing its displacement or increasing its capacity (of goods and/or passengers), given an equal displacement.

Hull pitching is reduced in a different way from the current one: by breaking the waves, the rotor underneath creates a flat fluid surface on which the bottom can slide avoiding the continuous rising and lowering of its bow, as occurs with ordinary ships that follow the profile of waves. Thus, the hull is likely to reach regular stability at any speed. Pitching and rolling are also reduced by bilge keels and longitudinal channels on the bottom: high speed water pressure on channels' walls considerably contributes to balance the hull, as occurs on rails in the sector of railway transport.

If it is equipped with this propelling system, a watercraft will fear no sea storm. Its forward rotor ploughs through the breakers that oppose the ship heading, while wave crests crash against its hemispherical bow, which prevents negative buoyancy.

Therefore, a watercraft pierces the waves instead of rolling on their profiles.

All these improvements will allow merchant watercrafts to reach speeds that were inconceivable until yesterday. This increase in speed results in lower running costs: indeed a watercraft built according to the above-mentioned features can make—in the same period of time—many more trips (thus transporting more passengers and/or goods) than current ships, considerably reducing fixed costs and increasing gross proceeds.

BRIEF DESCRIPTION OF THE DRAWINGS

Further characteristics and advantages of this invention will be highlighted by the attached drawings regarding a preferable—yet not exclusive—realization of this propelling system as a not-restrictive example, whereof:

FIG. 10 shows a front view of the above-mentioned epicyclic gear train inside a cylindrical wheel;

FIG. 11 shows a simplified lateral view of the same epicyclic gear train;

FIGS. 12, 13 and 14 show a front view of the components of ratchet gears embodied in some epicyclic gear train;

DETAILED DESCRIPTION OF THE PREFERRED EMBODIMENTS

Figure 1:
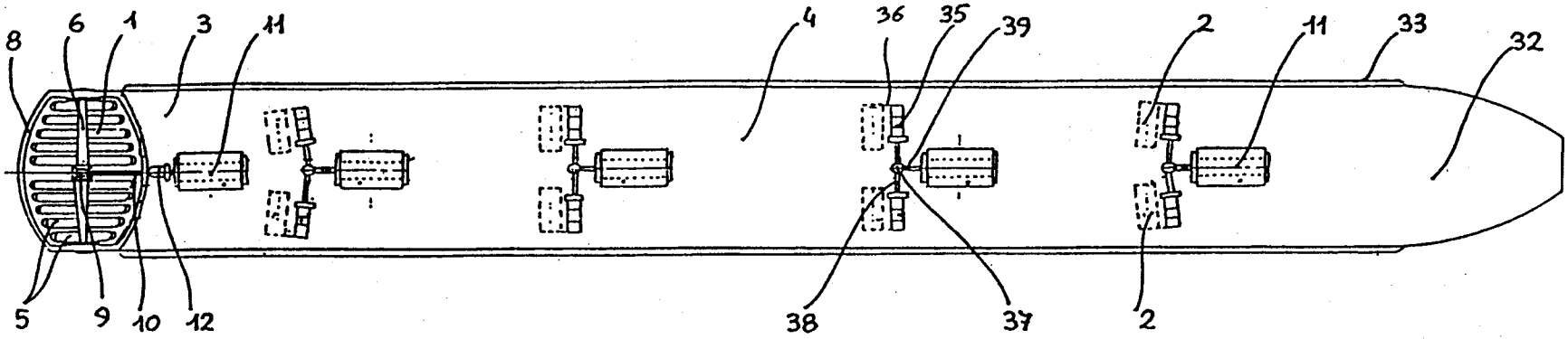
FIG. 1 shows a horizontal section, along the body plan of a hull equipped with the above-mentioned propelling system, and underlines the connections between the engines and various propelling devices.
Figure 2:
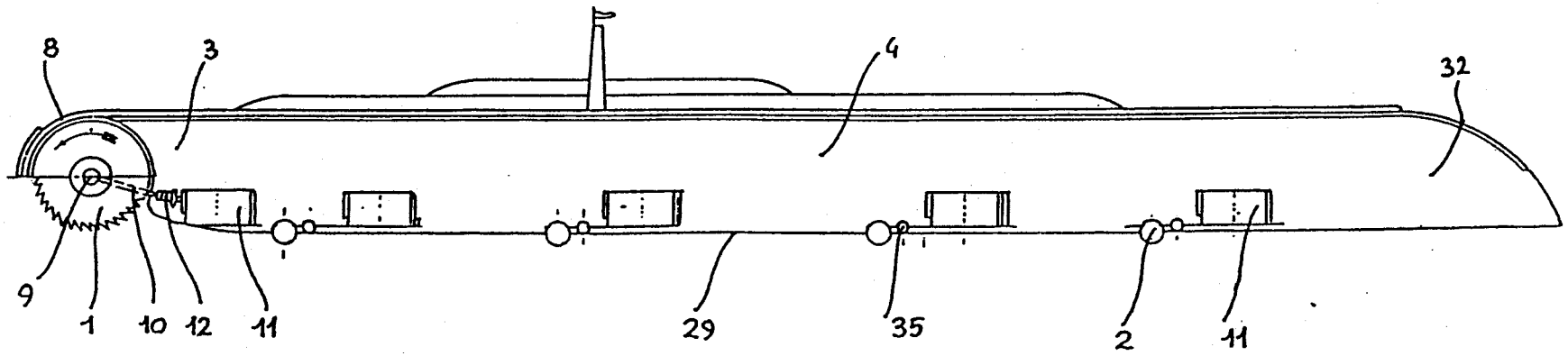
FIG. 2 shows a vertical section of the same hull along its sheer plan.
Figure 3:
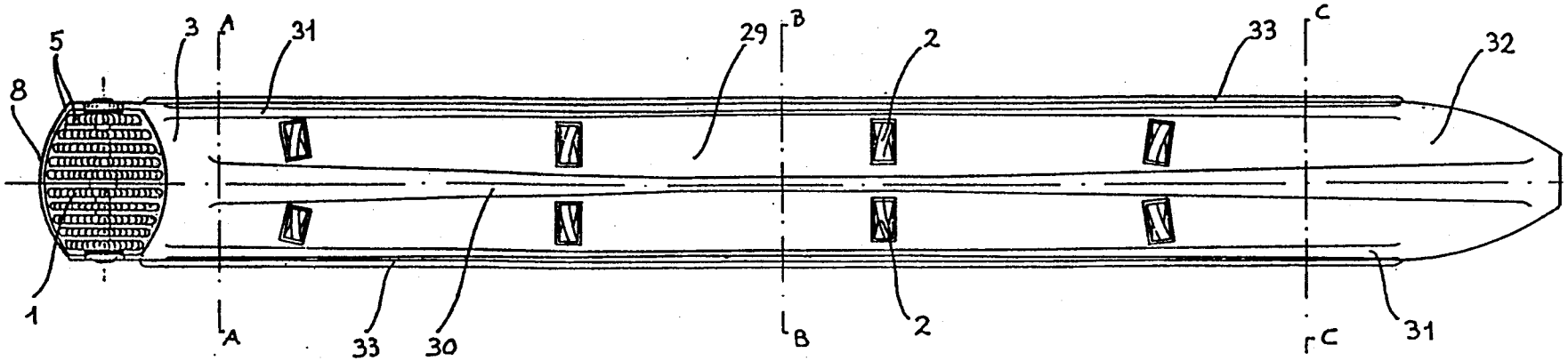
FIG. 3 shows a plan of the hull bottom, where a set of channels and the above-mentioned propelling devices can be noted.
Figure 5:
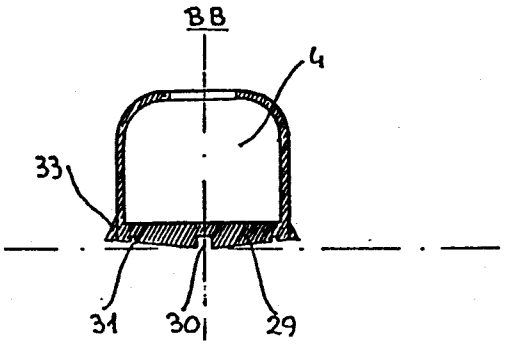
FIGS. 4, 5 and 6 show three cross-sections of the hull, according to sections AA, BB and CC respectively, as shown in FIG. 3.
Figure 6:
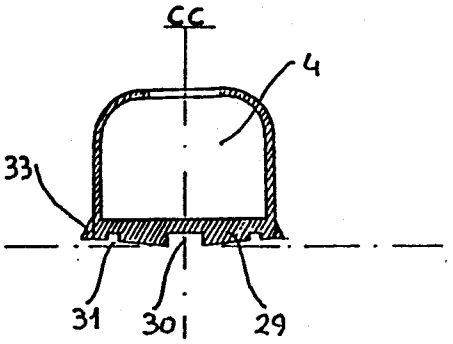
Figure 4:
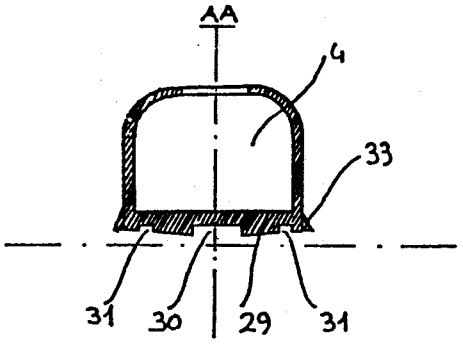
Figure 8:
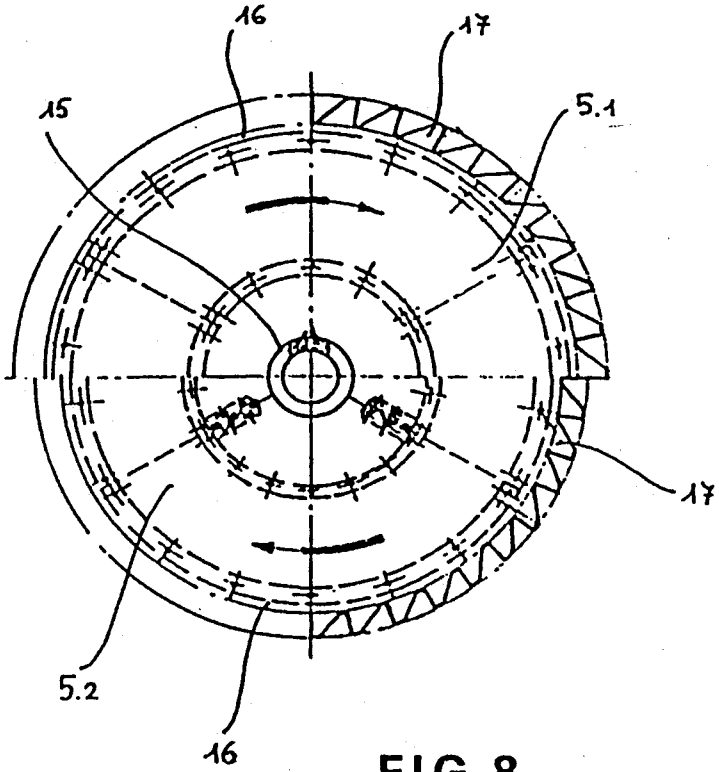
FIG. 8 shows the front view of two cylindrical wheels of the main rotor.

To be more precise, this propelling system fundamentally consists of a main rotor 1, one set of channels and eight secondary rotors 2.

The main rotor 1 is located at bow 3 of the hull 4; it consists in two sets of cylindrical wheels 5, splined onto two coaxial axle shafts 6 (right and left), which are transversal to the hull.

Each axle shaft 6 is subdivided into three parts and has one end bolted on side plate 7 stiffly connected to coverage 8, whereas its other end is inserted into differential 9 (placed at the centre of the main rotor 1), which is connected with the engine 11 through driving shaft 10.

Between the differential 9 and the engine 11 there is a gear box 12; a pulley 13 is located at the end of each axle shaft 6.

Figure 7:
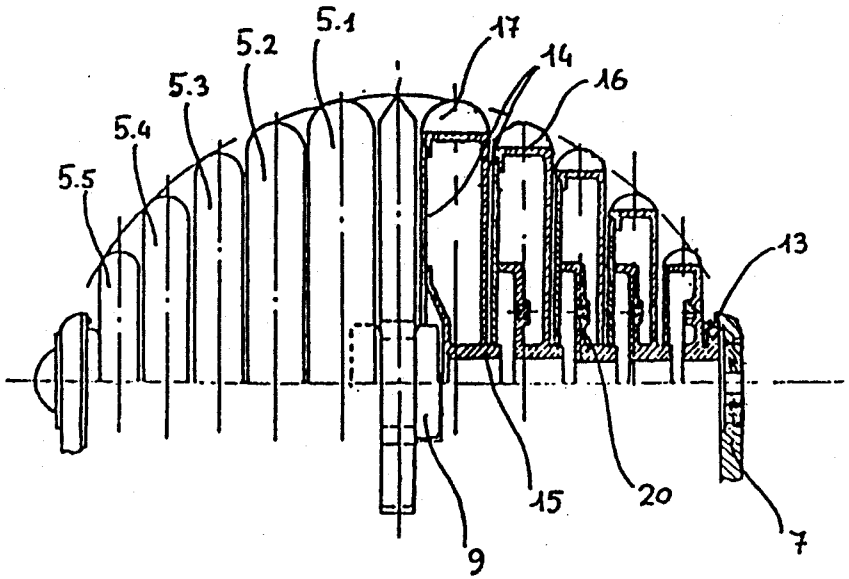
FIG. 7 shows a detailed view of the main forward rotor, with its own horizontal section.
Figure 9:
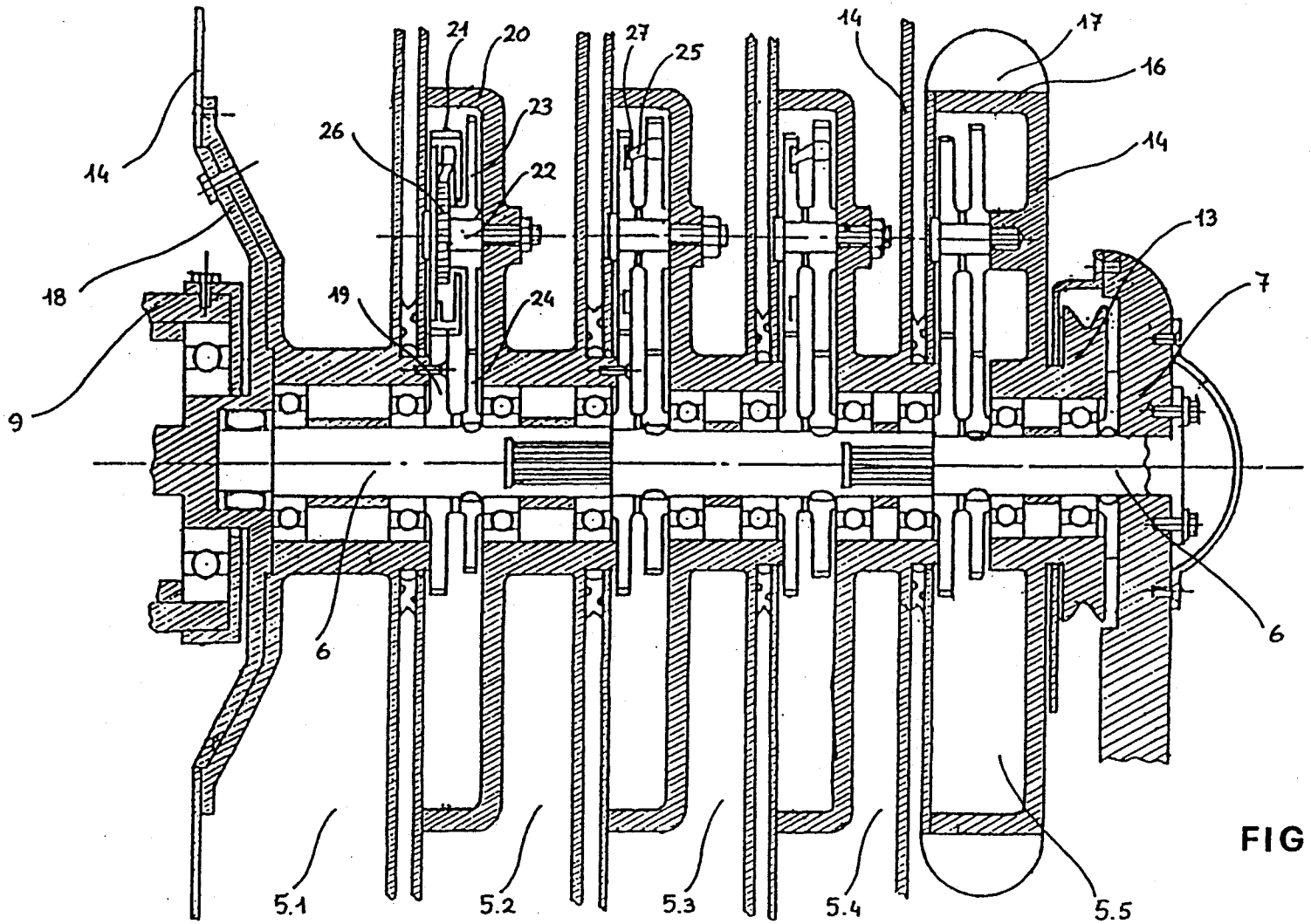
FIG. 9 shows a section of five cylindrical wheels along the rotation axis of the main rotor, pointing out the epicyclic gear train and the connection with the differential.
Figure 16:
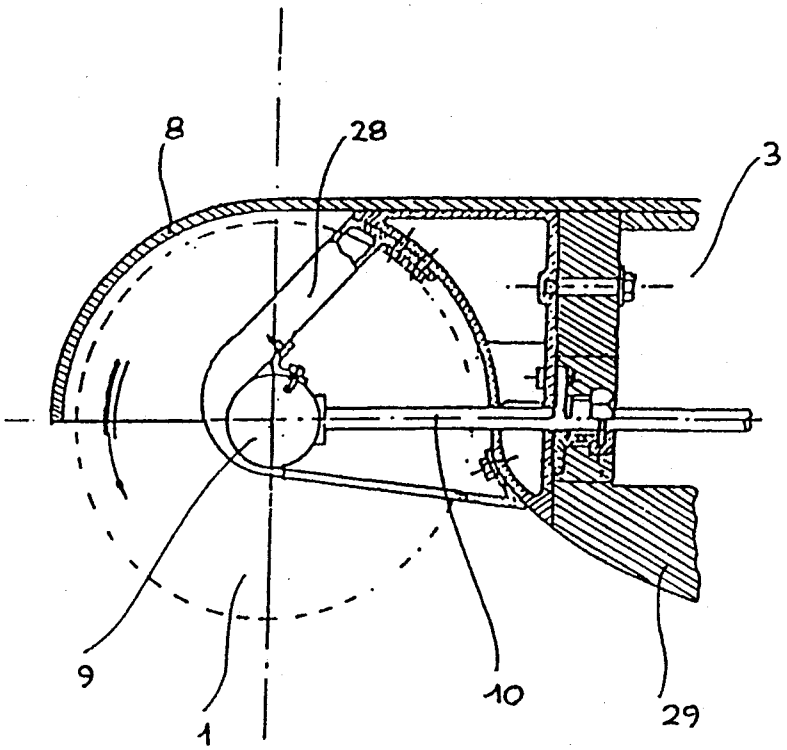
FIG. 16 shows a section of the bow along its sheer plan, pointing out the supporting frame of the differential and the position of the above-mentioned hemispherical coverage.
Figure 15:
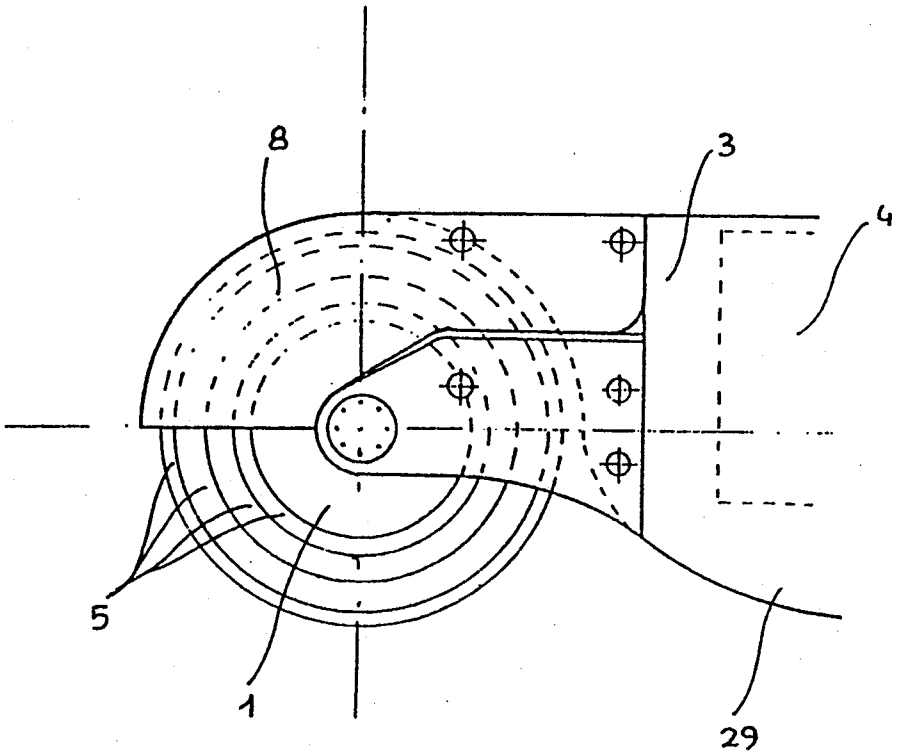
FIG. 15 shows a lateral view of the hemispherical coverage of the main rotor, highlighting the connections with the bow of the hull.
Figure 18:
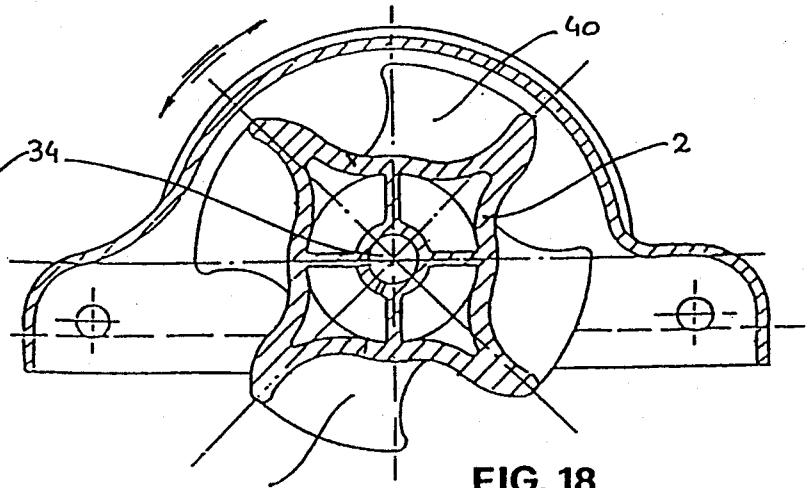
FIG. 18 shows the cross-section of the rotor shown in the previous Figure.
Figure 17:
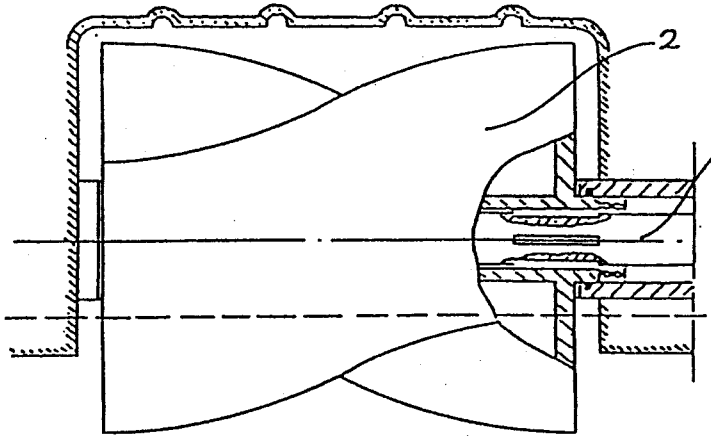
FIG. 17 shows the front view and partial longitudinal section of one of the secondary rotors.
Figure 19:
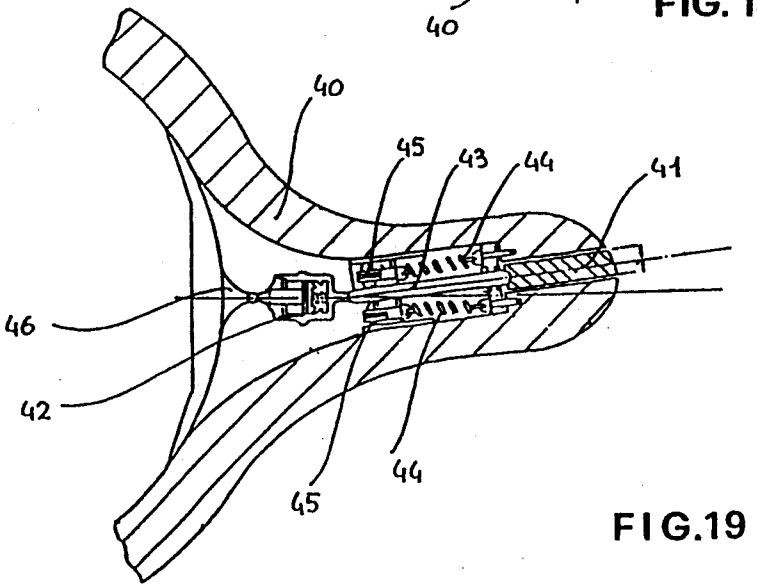
FIG. 19 shows the cross-section of a blade of the same secondary rotor, highlighting the fin ejection mechanism embodied in the blade itself.

Each set of cylindrical wheels 5 includes cylindrical wheels 5.1, 5.2, 5.3, 5.4 and 5.5 as shown in FIGS. 7 and 9; each cylindrical wheel consists of disks 14 (one of them is removable), a hub 15 and a crown 16, whose external surface supports blades 17; each blade 17 has a horse-hoof shape and a saw-tooth profile. The cylindrical wheels 5 of each set have growing diameters from outer wheel to differential 9, so that the cylindrical wheel 5.1 nearest to the differential 9 is the largest one.

This cylindrical wheel 5.1 is fastened (by means of one of its disks 14) to the circular flange 18, which is connected to differential 9.

The hub 15 of cylindrical wheel 5.1 is connected to the toothwheel 19, which is coaxial to axle shaft 6. The most external cylindrical wheel 5.2, unlike the one described above, contains the cylindrical capsule 20, which contains some gears forming an epicyclic gear train.

The latter comprises three toothwheels 21 located on three internal axles 22 (which are fastened to capsule 20, parallel to axle shaft 6 and symmetrically arranged around it), three toothwheels 23 (also placed on internal axles 22 and fastened to capsule 20), and toothwheel 24, keyed on axle shaft 6.

Each toothwheel 21 has three pawls 25 on its internal crown; these pawls 25 act on the saw-tooth wheel 26, stiffly connected to the internal axle 22. The other cylindrical wheels 5.3, 5.4 and 5.5 are similar to the cylindrical wheel 5.2, except for their assembly simplification concerning the abovementioned ratchet gear; they do not have any sawtooth wheel 26, and their pawls 25 are fastened to toothwheels 23. Their pawls 25 are inserted into suitable the recesses 27 made on toothwheels 21. The differential 9 is supported by a frame 28, whose lower part is integral to the bow 3 of the hull 4 and upper part to the forward coverage 8.

Forward coverage 8 has a hemispheric shape and is made of calendered reinforced sheet iron; it protects the top, front and sides of the main rotor 1 (it nearly reaches sea level) and is bolted to the bow 3. The set of channels is made on the bottom 29 of hull 4. To be more precise, these channels consist of one central channel 30 and two lateral channels 31, which are symmetrical to the central one. All of these channels are longitudinal to the hull and present all along the bottom 29.

The central channel 30 is made along the longitudinal and central part of the bottom 29; the central channel 30 has different cross-sections, which decrease from bow 3 and stern 32 to the centre of hull 4.

Lateral channels 31 are located along the right and left sides of the bottom 29; they too have different cross-sections along the longitudinal profile, similarly to the central channel 30 described above. However, the sizes of their cross-sections vary in a lower degree.

The bottom 29 of the hull 4 is practically flat in its longitudinal central part (where the central channel 30 lies), whereas it is slightly inclined transversally and upwardly, along the sides of the bottom 29.

Moreover, the whole bottom 29 is slightly tilted lengthwise and upwardly towards the forward part. Finally, there is a bilge keel 33 along each side of bottom 29; each bilge keel has a triangular cross-section and extends along all the bottom 29.

Eight secondary rotors 2 are arranged in pairs (right and left) transversally, in four different positions along the sheer plan of hull 4; they are housed in half-cylinders made on the bottom 29.

Each of them is supported by its own shaft 34 transversal to craft, connected with a speed-change gear 35 through a driving belt 36; in its turn, the gear box 35 is connected with the differential 37 through an axle shaft 38.

Finally, motion transmission is driven from the engine 11 to the differential 37 by a driving shaft 9.

Each secondary rotor 2 consists in a hollow cylinder, whose external surface supports four blades 40 with a helicoidal profile.

Inside each blade 40 of a secondary rotor 2, there is a hydraulic expansion unit, which allows the ejection of the fin 41 at blade tip. This unit consists of a cylinder with a hydraulic piston 42, a central rod 43, return springs 44, guide supports 45 for return springs 44, and unit fastenings 46.

The stern 32 of the hull 4 is completely different from those used on traditional ships t present. It has a hemispheric profile blending with bottom 29. The upperworks of hull 4 has an aerodynamic shape, also thanks to the lack of any superstructure, such as chimneys, masts, upper decks and turrets, etc.

That being stated, this propelling system operates as follows: the heading of the hull 4 is substantially powered by the main rotor 1 driven by the engine 11. To be more precise, power is transmitted to the differential 9 through a driving shaft 10; the differential 9 drives circular flanges 18, each of which is fastened to the cylindrical wheel 5.1 of each unit and causes its positive rotation (i.e. ahead). Consequently, toothwheel 19, stiffly connected to cylindrical wheel 5.1, is also forced into motion.

Toothwheel 19 forces toothwheels 21 (constantly meshed with toothwheel 19) to rotate on their own internal axles 22.

This rotation is opposite to the rotation of toothwheel 19. Toothwheels 21 make toothwheels 23 rotate ahead. Indeed, during positive rotation, the above-mentioned ratchet gear stiffly connects all the gearings supported by the same internal axle 22 and, therefore, toothwheels 23 are forced to rotate in the same direction as toothwheel 21.

Toothwheels 23 are stiffly connected with the capsule 20 of the cylindrical wheel 5.2 and force it to rotate, too.

Toothwheel 24 is splined onto axle shaft 6 but is not stiffly connected with cylindrical wheel 5.2; toothwheel 24 contributes to the rotation of toothwheels 23 (and of all the gear units fastened on internal axles 22).

The rotation of cylindrical wheel 5.2 also contributes to the rotation of toothwheel 19, which is stiffly connected to it; with a similar sequence of movements, motion is therefore transmitted to cylindrical wheels 5.3, 5.4 and 5.5.

When the braking device acting on pulley 13 is set on, the cylindrical wheel 5.5 stiffly connected with pulley 13 suddenly slows down. This makes toothwheel 19 stiffly connected with cylindrical wheel 5.4 slow down; as a consequence, also the toothwheels 23 of the above-mentioned cylindrical wheel 5.4 slow down. The gears integral with capsule 20 of cylindrical wheel 5.4 slow down and their motion is now opposite to heading. This disconnects pawls 25 from saw-tooth wheels 26 (or from recesses 27), so that the rotation of toothwheels 21 around toothwheel 19 becomes unforced.

Therefore, every time the main rotor 1 decelerates, each cylindrical wheel 5 can rotate independently of the others, at idle, thus preventing the axle shafts 6 from breaking for torsion overload. Actually, the cylindrical wheels 5.1 may cause this kind of stress, since they are not equipped with the above-mentioned gear units.

In addition, all the gear units contained in capsule 20 are made in such a way as to multiply the peripheral speed of both the cylindrical wheel 5 housing capsule 20 and, consequently, the adjacent one. An increase in peripheral speed is necessary to enable each cylindrical wheel 5 (whatever its diameter is) to displace the same quantity of water during a certain lapse of time.

In order to easily carry out the maintenance and/or repair of the above-mentioned gear units, the two axle shafts 6 are each divided into three parts, jointed together to facilitate the disassembly of each cylindrical wheel 5; once the cylindrical wheels 5 are taken out of axle shaft 6, it is easy to reach the gear units and take away the corresponding removable disk 14 from each gear unit.

As stated above, the function of the main rotor 1 is to allow the heading of the hull 4. This occurs thanks to the action of blades 17, which have been designed to vigorously thrust water towards stern 32 and allow the heading of the watercraft 4 by reaction.

However, this is not the only function of the main rotor 1. Actually, it breaks the lower parts of waves (compact sea mass) and flattens them, so that the hull 4 can proceed sliding on the resulting flat surface, with a remarkable reduction of pitching.

The function of coverage 8 is twofold: it allows crests of waves to crash against its surface, thus avoiding buoyancy, and it provides the bow 3 of the hull 4 with an aerodynamic shape.

The water thrusted by the main rotor 1 underneath the bottom 29 is partly conveyed into the lateral channels 31 and central channel 30 made on the bottom 29.

These channels, as already stated, have different cross-sections lengthwise along the centre line, in order to form a truncated cone at bow 3, a narrowing at the centre of the hull 4, and a second reverse truncated cone towards stern 32. This peculiar design of channels 30 and 31 allows the application of the Venturi effect: a fluid mass thrusted into these channels 30 and 31, as a result of variations in cross-sections between the bow 3 and the central narrowing, decreases its pressure and consequently increases its speed towards stern 32. Therefore, the channels 30 and 31 contribute to the propulsion of this watercraft 4.

A second function of these channels is the reduction of the rolling and pitching of the watercraft 4. The pressure of water (thrusted in by the main rotor 1) on the walls of these channels 30 and 31 contributes to balance the hull 4, exactly as occurs on rails in the railway transport sector. Together with the above-mentioned bilge keels 33, they provide the watercraft 4 with a great stability even at high speeds; they also contribute to avoid a dangerous inclination of the dead angle (causing the upsetting of the same) which might occur if the bottom 29 was not provided with them.

The secondary rotors 2 also have a twofold function, namely propulsion and manoeuvring.

Each pair of secondary rotors 2 is driven by an engine 11, through a driving shaft 39, a differential 37, axle shafts 38 and driving belts 36.

Propulsion is powered by the action of the helicoidal-profiled blades 40 of each secondary rotor 2: these blades thrust water towards stern 32. This action can be increased by ejecting a fin 41 from each blade 40, when the hull 4 is already sailing and the driving power necessary to start the main rotor 1 has been reduced.

To be more precise, this occurs thanks to a cylinder provided with a hydraulic piston 42. When this piston 42 is hydraulicly actuated, it acts on a rod 43, which is integral with the piston 42. This rod, fastened to the root of the fin 41, causes its ejection from a slot on the tip of each blade 40. When the hydraulic pressure on the piston 42 is released, some return springs 44 (placed sideways and stiffly connected with the rod 43) allow the fin 41 to withdraw to its original seat.

The second function of these secondary rotors 2 is to allow the manoeuvring of the hull 4, whether operating with the aid of the main rotor 1 or not. For instance, when the hull 4 is to sheer to the right, it is necessary to set on the braking device (acting on a pulley 13) of the gear unit 5 placed on the right, and simultaneously decrease (or stop)—through gear box 35—the rotation of the secondary rotors 2 placed on the same side. The differential 9 in the main rotor 1 and the differentials 37 in each pair of secondary rotors 2 function in such a way that the decreased rotation speed of the propelling device placed on the right is matched by an increase in rotation of those on the opposite side.

Therefore, the deceleration of the propelling devices on the right and the consequent acceleration of those on the left of the hull 4 make the latter turn to the right.

If provided with the above-mentioned manoeuvring devices, the hull 4 will be able to sheer by pivoting on a vertical axis placed at the hull centre, not at stern 32, as occurs on current ships equipped with helms.

For minor sheering (usually necessary in ports, waterways, etc.) it is possible to use only the secondary rotors 2—even separately.

These secondary rotors 2 are also essential in order to allow the hull 4 to go astern: the reverse rotation of all the secondary rotors 2, together with the simultaneous detachment of the main rotor 1, allows the reversing of motion of the hull 4.

The longitudinal central part of the bottom 29 is practically flat in order to facilitate the operation of the central channel 30.

The inclination of the bottom sides 29 towards bulwarks is made specially to facilitate the angle of direction and stability at high speeds.

Finally, the bottom 29 is slightly inclined lengthwise and upwardly at bow 3, in order to encourage the conveyance of water coming from the main rotor 1 into the channels 30 and 31.

This specific design of bottom 29 allows to reduce the draft of the hull 4 and encourage the heave of the whole hull 4 (especially of its forward part) when it sails at high speeds, thus favouring a remarkable reduction in wave and frictional resistance.

The hull upperworks 4 has an aerodynamic shape thanks to the hemispheric coverage 8 forming the bow 3, a constant profile with no sharp edge all along the hull 29, and a lean stern 32 blended with the hull 29.

This invention, as it stands, may undergo several modifications and variations, all within its inventive concept; all its components may be replaced with others technically equivalent.

I claim:

1. A propelling system for use with watercraft, said propelling system comprising:

a watercraft having a bow, a stern, and a bottom;

a main rotor for primary propelling of said watercraft;

said main rotor having an axle;

said main rotor mounted on said bow with said axle transverse to a vertical plane through a longitudinal axis of said watercraft;

wherein said main rotor (1) comprises:

two cylindrical wheel sets (5);

each of said two wheel sets supported by an axle shaft (6);

each said axle shaft (6) being fixed transverse to said vertical plane (4) and connected to a differential (9) driven by an engine (11) through a drive shaft (10) having a gear box (12);

each wheel of each said cylindrical wheel sets having a decreasing diameter from a first wheel closest to said differential (9) to a last wheel most distant from said differential (9);

said each wheel of each said cylindrical wheel sets having two removable disks (14), a hub (15 and a crown (16), whose external surface suports blades (17) having a horse-hoof profile;

said first wheel fastened to a circular flange (18), connected to said differential (9);

a hub (15) of said first wheel having a first toothwheel (19) coaxial with said axle shaft (6) that rotates a plurality of second toothwheels (21) on their internal axles (22);

said internal axles (22) fixed to a cylindrical capsule (20) located inside said each wheel;

said cylindrical capsule (20) housing said first toothwheel (19), said second toothwheels (21), third toothwheels (23) and a fourth toothwheel (24) forming an epicycloidic gearing;

said internal axles (22) being parallel to said axle shaft (6) and symmetrically located around said axle shaft (6);

said internal axles (22) also supporting said third toothwheel (23) stiffly connected to capsule (20) and linked to said second toothwheels (21) which are coaxial by means of pawls (25);

said pawls (25) alternatively acting on a saw-tooth wheel (26) integral with said internal axle (22) or on specific recesses (27) made on said second toothwheels (21);

said third toothwheels (23) being supported by said fourth toothwheel (24) which is keyed on axle shaft (6) and spaced from its adjacent cylindrical wheel;

said axle shaft (6) being fastened onto one end of a side plate (7), close to a pulley (13);

a braking system on each of said two of cylindrical wheel sets, acting on said pulley (13);

said differential (9) being supported by a frame (28);

said frame (28) having a lower part integral to said bow (3) and an upper part to provide support for forward coverage (8); and said forward coverage (8) having a hemispheric shape which forms part of said bow (3) and protects a top, front and sides of said main rotor (1).

2. A propelling system for use with watercraft, said propelling system comprising:

a watercraft having a bow, a stern, and a bottom;

a main rotor for primary propelling of said watercraft;

a plurality of secondary propelling means on said bottom for additionally propelling and maneuvering said watercraft;

wherein said secondary propelling means comprises;

a plurality of pairs of secondary rotors (2) on said bottom;

each of said pairs symmetrically located to each other around a vertical plane through a longitudinal axis of said watercraft;

each of said secondary rotors (2) comprising:

a cylinder whose peripheral surface has a plurality of blades (40);

said cylinder being supported by a shaft (34), which is substantially transverse to said vertical plane and connected, by means of driving belts (36) or axle shafts (38);

said axle shafts provided with a gear box (35), connected to a differential (37);

said differential being connected to an engine (11) by means of a drive shaft (39);

each of said plurality of blades (40) having a fin (41), which is ejected from a tip of each of said plurality of blades by a hydraulic piston (42) sliding in a cylinder;

said piston (42), when hydraulicly actuated, acting on a rod (43) stiffly connected with said fin (41) causing the fin ejection; and return springs (44) to return said fin (41) to its original position when the hydraulic pressure on said piston (42) is released.

* * * * *